US009205487B2

(12) United States Patent
Osborne et al.

(10) Patent No.: US 9,205,487 B2
(45) Date of Patent: Dec. 8, 2015

(54) COMPENSATION MECHANISM FOR CAST ROTOR LAMINATION STACK HEIGHT AND COMPRESSION PRESSURE CONTROL

(71) Applicant: GM Global Technology Operations LLC, Detroit, MI (US)

(72) Inventors: Richard J. Osborne, Shelby Township, MI (US); Kevin P. Coleman, Livonia, MI (US); Margarita P. Thompson, Livonia, MI (US); Qigui Wang, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 249 days.

(21) Appl. No.: 14/105,239

(22) Filed: Dec. 13, 2013

(65) Prior Publication Data

US 2015/0165523 A1 Jun. 18, 2015

(51) Int. Cl.
*B22D 19/00* (2006.01)
*B22D 17/24* (2006.01)

(52) U.S. Cl.
CPC ..... *B22D 19/0054* (2013.01); *B22D 17/24* (2013.01)

(58) Field of Classification Search
CPC ..... B22D 17/24; B22D 19/0054
USPC ..... 164/108–112, 332–334
See application file for complete search history.

(56) References Cited

U.S. PATENT DOCUMENTS 6,206,080 B1 * 3/2001 Ji ..... B22D 17/10 164/332
6,848,495 B2 * 2/2005 Edwards ..... B22D 19/0054 164/109
6,991,021 B2 * 1/2006 Ramirez ..... B22D 13/04 164/103

* cited by examiner

*Primary Examiner* — Kevin E Yoon
(74) *Attorney, Agent, or Firm* — Dinsmore & Shohl LLP

(57) ABSTRACT

Integrated devices and methods for compensating electric grade steel lamination stack height for use in a conventional two-plate high pressure die cast tool used for casting aluminum induction rotors. These devices and methods allow for significant variation in the lamination stack height without associated failures related to stack height variation, and also ensure constant and accurate clamping pressure on both the OD and ID of the steel lamination stack which prevents electric insulation damage, metal flow between laminations, large casting metal flash, and tool damage for excessive height laminations stacks. The clamping pressure is adjustable and is actuated from a single hydraulic cylinder which allows for a wide range of pressures to accommodate fine adjustment of clamping pressure to insure no damage occurs to the laminations.

23 Claims, 7 Drawing Sheets

COMPENSATION MECHANISM FOR CAST ROTOR LAMINATION STACK HEIGHT AND COMPRESSION PRESSURE CONTROL

FIELD OF THE INVENTION

The present invention relates to integrated devices and methods for compensating electric grade steel lamination stack height for use in a two-plate high pressure die cast tool used for casting induction rotors. The devices allow for variation in lamination stack height and ensure constant clamping pressure on both the outside diameter (OD) and inside diameter (ID) of the steel lamination stack.

BACKGROUND OF THE INVENTION

Increasing demands in fuel efficiency have made hybrid systems more attractive in the automotive industry. In addition to a conventional combustion engine, an electric motor is an important part of the hybrid system. Alternating current (AC) induction motors are commonly used because they offer simple, rugged construction, easy maintenance and cost-effectiveness. The AC induction motor includes two major assemblies: a stator and a rotor. The stator is the outermost component of the motor and is composed of steel laminations shaped to form poles, with copper wire coils wound around the poles. The primary windings are connected to a voltage source to produce a rotating magnetic field. The rotor (often referred to in one form as a squirrel cage rotor) is a cylinder that is mounted on a shaft or mandrel to electromagnetically cooperate with the stator. The rotor is formed of longitudinal conductor bars cast into generally peripheral slots and cast together at both ends with short rings forming a cage-like shape. FIG. 1 shows an illustration of a notional induction motor 1 with a cast rotor 3 that may spin in response to changes in a magnetic field in stator 5. The core of the rotor 3 is built with stacks of electrical grade steel laminations 4 and aluminum or copper alloy rotor bars 7 are cast through conducting bar slots formed in the laminations 4 and end rings 9 creating an integrated squirrel cage structure.

As depicted in FIG. 1, a rotating magnetic field around the rotor 3 is generated from the field windings 11 in the stator 5 of an induction motor 1. Electric current is generated in the conductor bars 7 from the relative motion between the rotor 3 and the rotating magnetic field around the rotor 3. These lengthwise-flowing electric currents in the conductor bars 7 react with the magnetic field of the motor 1, producing force acting at a tangent to the rotor 3. This results in torque to turn the shaft or mandrel 20 and the rotor 3. In operation, the rotor 3 is carried around with the magnetic field, but at a slightly slower rate of rotation. The difference between the speed of the rotor and the speed of the magnetic field is called slip, and the slip increases with load.

Conductor bars 7 are usually skewed slightly along the length of the rotor 3 (i.e., the conductor bars 7 are not perpendicular to the plane of the end rings 9 where the end ring attaches to the conducting bars 7), as shown in FIG. 1. This results in the reduction of noise and also smoother torque fluctuations. Torque fluctuations can result in some speed variations due to interactions with the pole pieces of the stator 5. The extent to which the induced currents are fed back to the stator field winding coils 11, and thus the current through the coils, is determined by the number of conductor bars 7 on the squirrel cage. Constructions that use a prime number of bars offer the least feedback.

The iron core (laminated steel stack) carries the magnetic field across the motor. The structure and materials for the laminated steel stack are specifically designed to minimize magnetic losses. The thin laminations (electrical steel sheets), separated by an insulating coating, reduce stray circulating currents that would result in eddy current loss. Further reducing eddy-current loss is the fact that the material for the laminations is a low carbon, high silicon steel with several times the electrical resistivity of pure iron. The low carbon content makes it a magnetically soft material with low hysteresis loss.

The same basic design is used for both single-phase and three-phase motors over a wide range of sizes. However, the depth and shape of bars for three-phase motors will have variations to suit the design classification.

A common aluminum squirrel cage induction rotor construction method with a conventional two-plate high pressure die casting tool starts with an iron core of stacked thin stamped coated steel laminations compressed to a specified height and clamp pressure. Importantly, the lamination stack must be held and accurately compressed. Without proper lamination stack height compensation an assembly of too many laminations could prevent full die closure resulting in a large casting flash. An assembly of too few laminations can result in low compression force on the lamination stack causing metal to penetrate between laminations and under the mandrel, potentially causing tooling damage. Furthermore, lamination stacks compressed below specified pressure allow for infiltration of molten aluminum between individual laminations resulting in increased eddy current losses thereby reducing motor efficiency. Lamination stacks compressed at too high of pressure can result in damage to lamination insulation, also resulting in increased eddy current loss thereby reducing motor efficiency. Additionally, lamination stacks compressed at too high of pressure can increase conducting bar tension stress resulting from lamination stack spring back causing rotor distortion and loss of durability during use.

Therefore, there is a need for an integrated compensation device assembly for lamination stack height for use in a conventional two-plate high pressure die cast tool used for casting aluminum induction rotors that will allow for variation in lamination stack height and ensure constant clamping pressure on the steel lamination stack, as well as for improved methods of compensating for lamination stack height variation in the manufacture of die cast aluminum induction rotors.

SUMMARY OF THE INVENTION

The invention relates to integrated devices and methods for compensating electric grade steel lamination stack height for use in a two-plate high pressure die cast tool used for casting aluminum induction rotors. These devices and methods allow for significant variation in the lamination stack height without associated failures related to stack height variation, and also ensure constant and accurate clamping pressure on both the OD and ID of the steel lamination stack which prevents electric insulation damage, metal flow between laminations, large casting metal flash, and tool damage for excessive height laminations stacks. The clamping pressure is adjustable and is actuated from a single hydraulic cylinder. The systems mechanical advantage allows for a very wide range of pressures to accommodate fine adjustment of clamping pressure to insure no damage occurs to the laminations.

One aspect of the invention relates to a rotor die casting device comprising an integrated lamination stack height compensation assembly. In one embodiment the integrated lamination stack height compensation assembly includes: a moveable slider plate having at least one tapered surface; an annular die cast component arranged perpendicular to an axis of motion of the slider plate; a plurality of posts positioned about the perimeter of the annular die cast component, an end of each post in contact with a tapered surface of the slider plate; a mandrel positioned coaxial to the annular die cast component and comprising a stepped distal periphery such that a plurality of ferromagnetic laminations stacked may be stacked there between, the stack defining a lamination stack height, an outer diameter and an inner diameter; and a compensation ring disposed along the distal periphery, the compensation ring configured to interposition with the stepped distal periphery of the mandrel such that a clearance gap exists between the mandrel and the compensation ring, the assembly configured such that upon activation, the slider plate engages and guides the posts up the tapered surface to transfer a compressive force through the annular die cast component such that a clamping pressure is applied to the outer diameter of the lamination stack, the compressive force sufficient to deform the compensation ring to close the clearance gap a compensating degree sufficient to ensure that the compensation ring applies a clamping pressure to the inner diameter of the lamination stack.

Another aspect of the invention relates to a method of compensating for lamination stack height variation in the manufacture of a die cast rotor. In one embodiment, the method includes providing a compensation assembly integrated with a die casting tool, said compensation assembly comprising a moveable slider plate having at least one tapered surface; an annular die cast component arranged perpendicular to an axis of the slider plate; a plurality of posts positioned about the perimeter of the annular die cast component, an end of each post in contact with a tapered surface of the slider plate; a mandrel positioned coaxial to the annular die cast component and comprising a stepped distal periphery such that a plurality of ferromagnetic laminations stacked may be stacked there between, the stack defining a lamination stack height, an outer diameter and an inner diameter; a compensation ring disposed along the distal periphery, the compensation ring configured to interposition with the stepped distal periphery of the mandrel such that a clearance gap exists between the mandrel and the compensation ring, the assembly configured such that upon activation, the moveable slider plate engages and guides the posts up the tapered surface to transfer a compressive force through the annular die cast component such that a uniform clamping pressure is applied to the outer diameter of the lamination stack, the compressive force sufficient to deform the compensation ring to close the clearance gap to a compensating degree to ensure that the compensation ring applies a uniform clamping pressure to the inner diameter of the lamination stack.

Additional features and benefits of the invention will become apparent from the following detailed description with appropriate reference to the accompanying drawings.

DETAILED DESCRIPTION OF THE INVENTION

Figure 1:
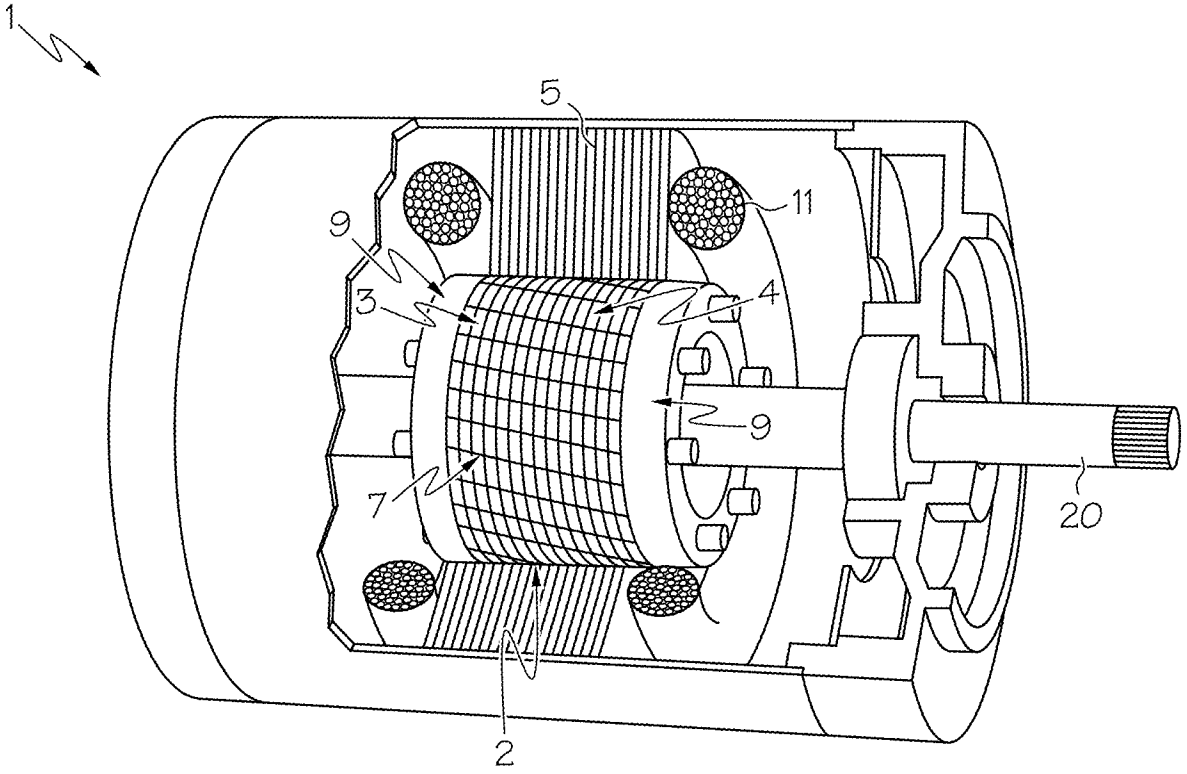
FIG. 1 shows a perspective cutaway of a motor showing with particularity the relationship between a stator and a cast rotor.
Figure 2:
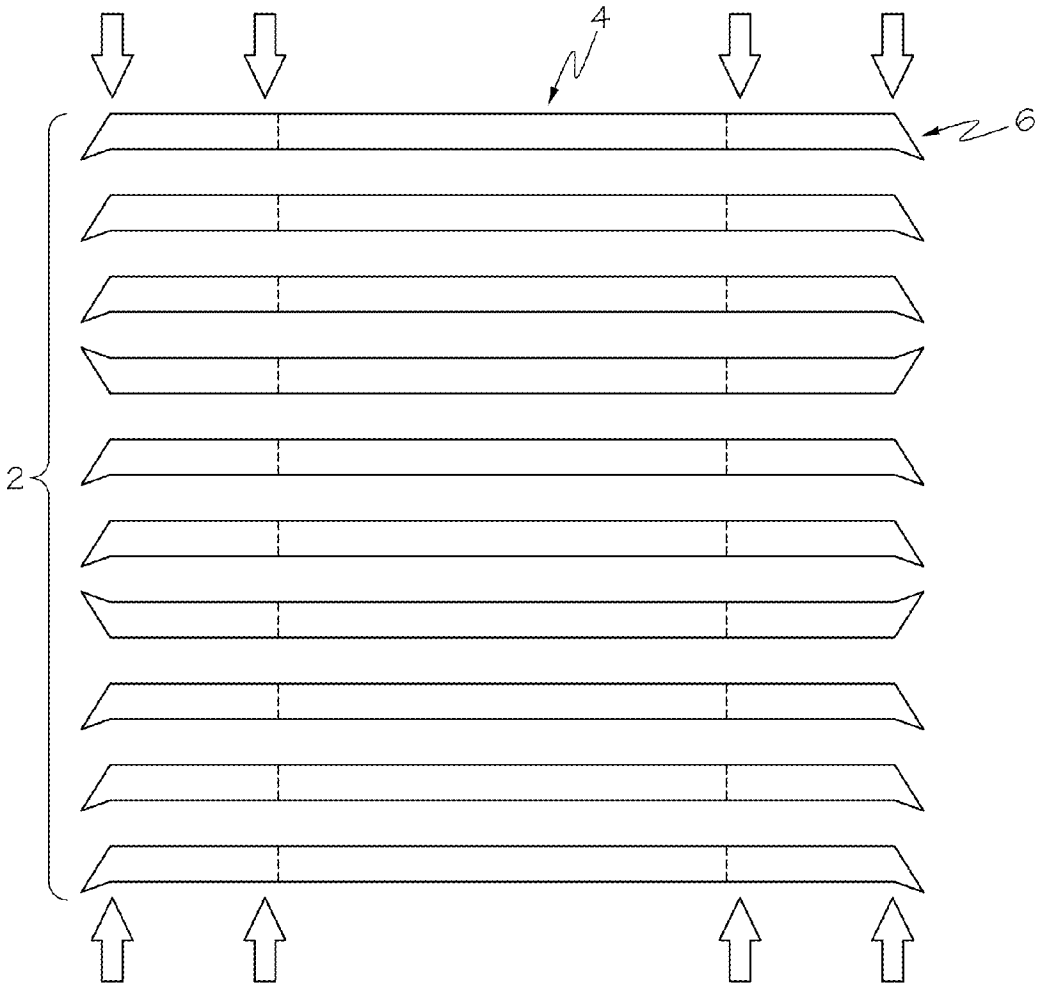
FIG. 2 is an illustration of how lamination stamping edge burrs can affect stack height.
Figure 3:
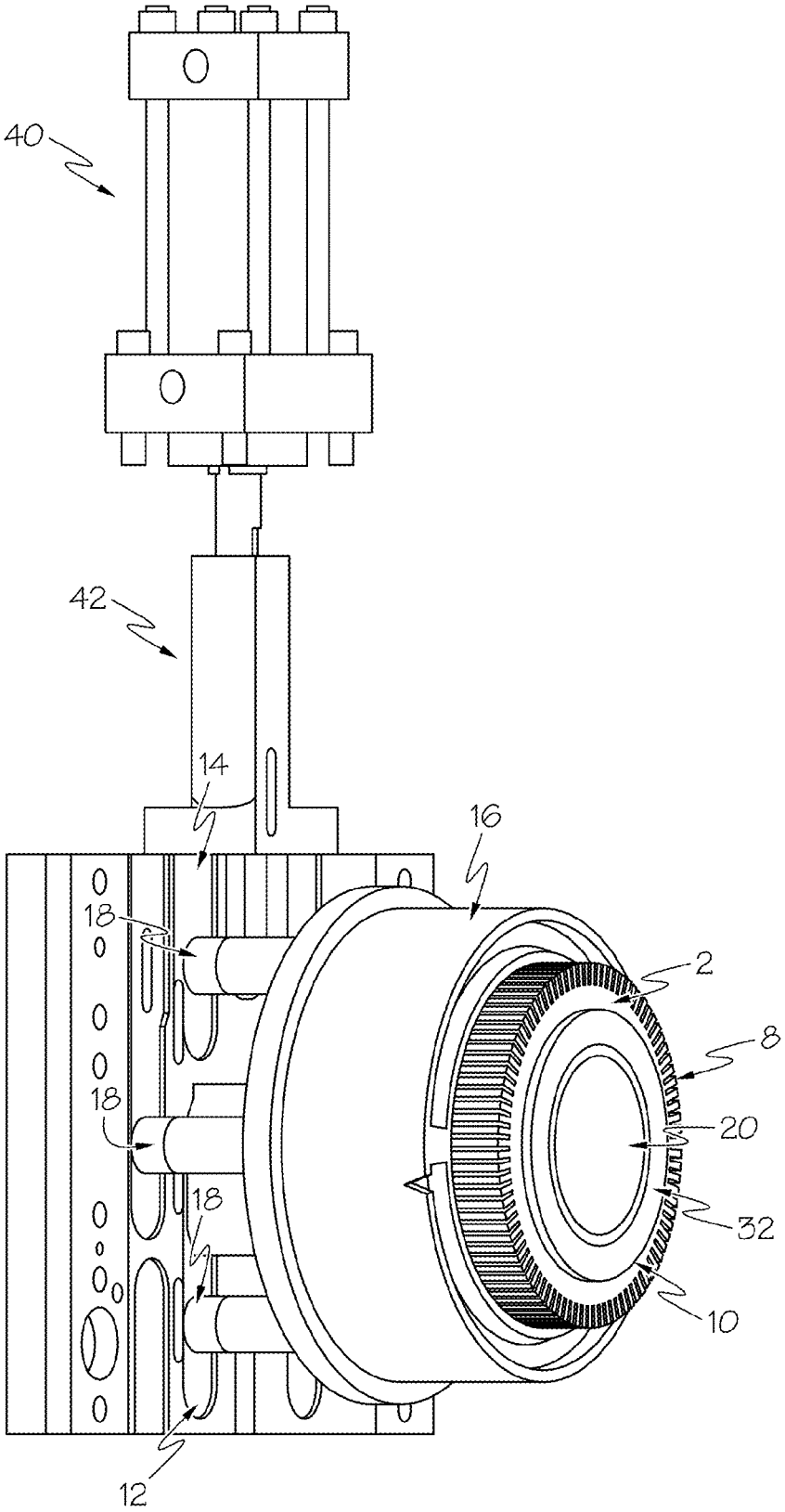
FIG. 3 illustrates two-plate die compensation devices for controlling OD stack compression.
Figure 4:
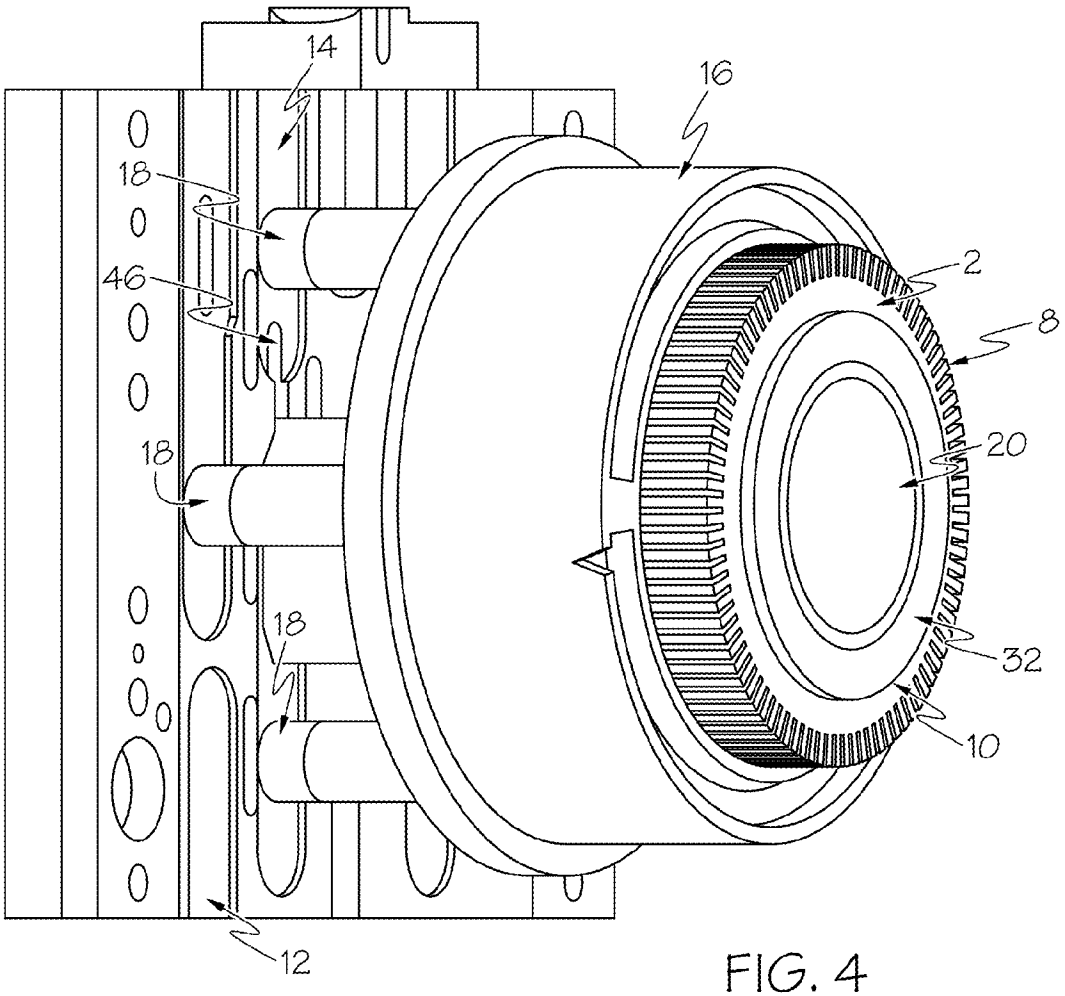
FIG. 4 illustrates a close-up of on key components of the two-plate die compensation devices for controlling OD stack compression.
Figure 5:
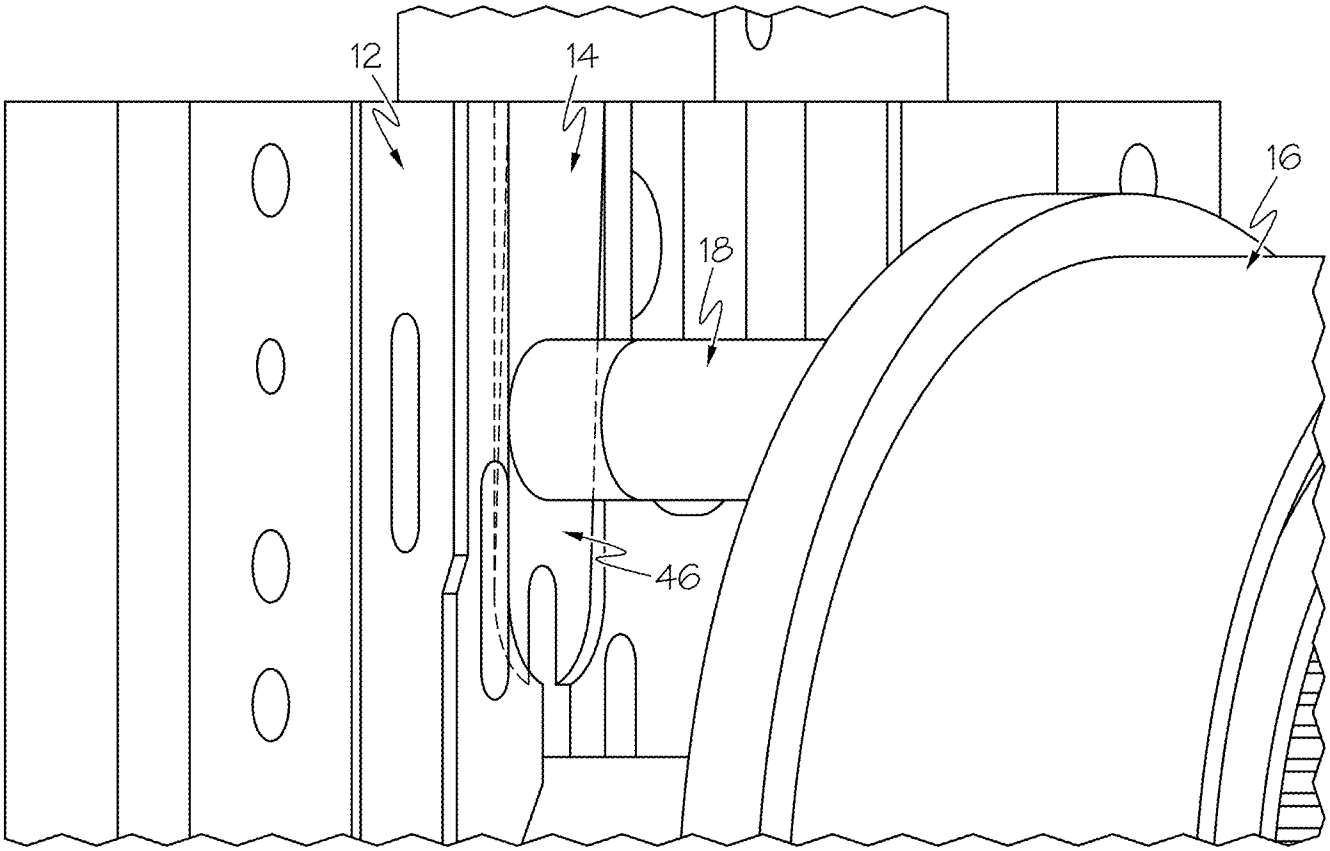
FIG. 5 illustrates the angled (tapered) slider plate of the two-plate die compensation devices for controlling OD stack compression.
Figure 6:
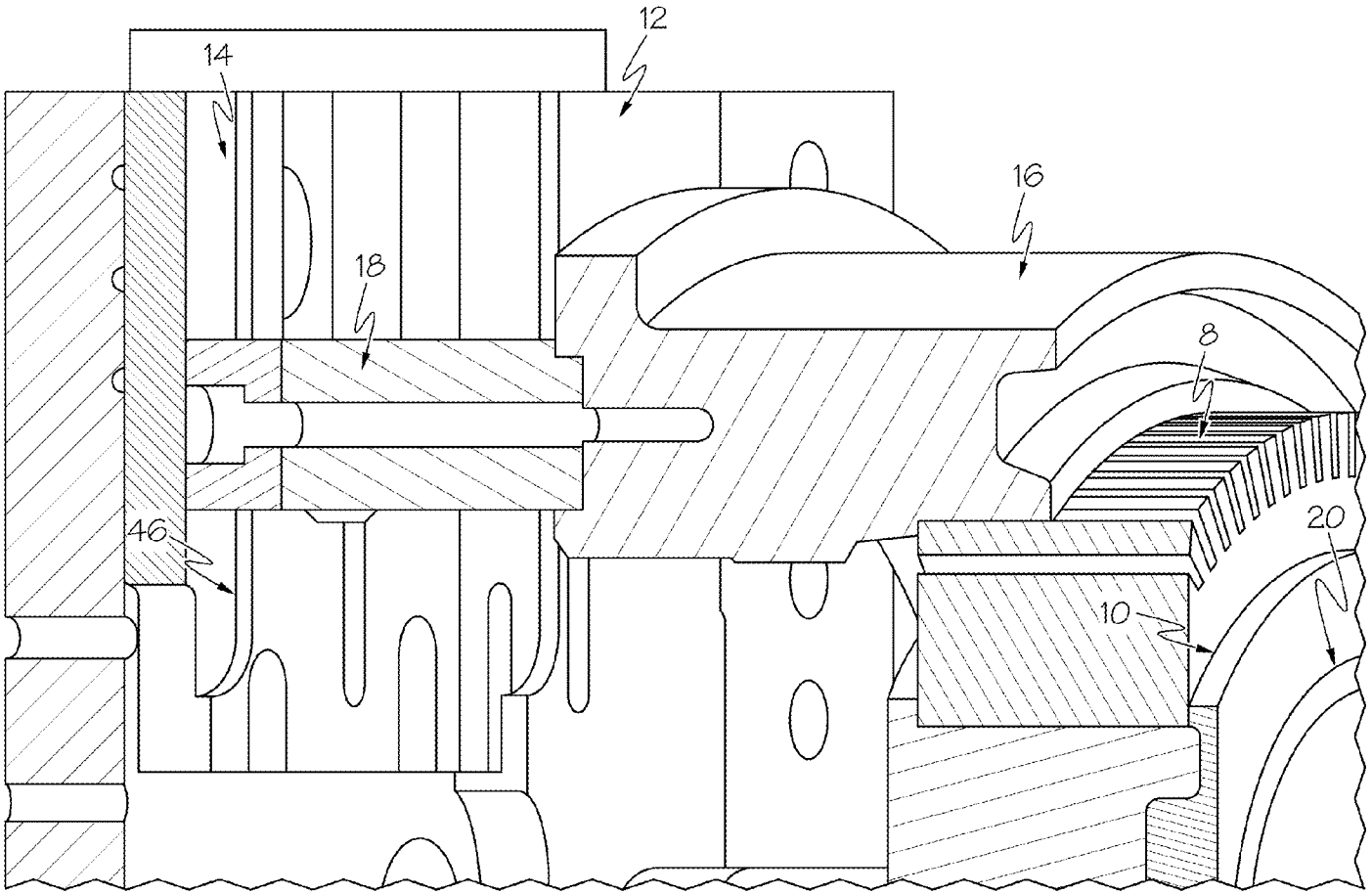
FIG. 6 illustrates a cut-section through the two-plate die compensation devices for controlling OD stack compression.

It is important to have adequate and accurate pressure on the lamination stack 2 to hold it in position with known stack height and clamp compression pressure. As shown in FIG. 2, laminations 4 typically exhibit a small edge burr 6 caused during stamping and the edge burrs 6 continue to get worst with increased stamping die use which can lead to increased lamination stack height variation (note: lamination drawings do specify a maximum burr height). An exaggerated example of lamination edge burrs 6 which can influence core stack height is shown in FIG. 2. As shown in FIG. 2, additional problems can arise if there is not adequate and accurate pressure on the lamination stack 2. During the stamping process and/or manual stacking of laminations 4 they can occasionally become flipped, resulting in additional stack height variation. Furthermore, laminations 4 can have a slight shift from center during stamping, resulting in an increased burr 6 effect. The devices and methods described allow for significant error in the assembly of the laminations stack height without associated failures related to stack height variation. An assembly of too many laminations 4 could prevent full die closure resulting in large casting flash. An assembly of too few laminations 4 can result in low compression force on the lamination stack 2 causing metal to penetrate between laminations 4 and under the mandrel 20 potentially causing tooling damage. The devices and methods described improve stack height compensation related to lamination stamping variation and inconsistent lamination assembly count, and are designed to allow variance on +/− five lamination 4 plus individual lamination burr 6 height. Of note, greater stack lamination count and height variance can be designed into the system if desired.

Figure 7:
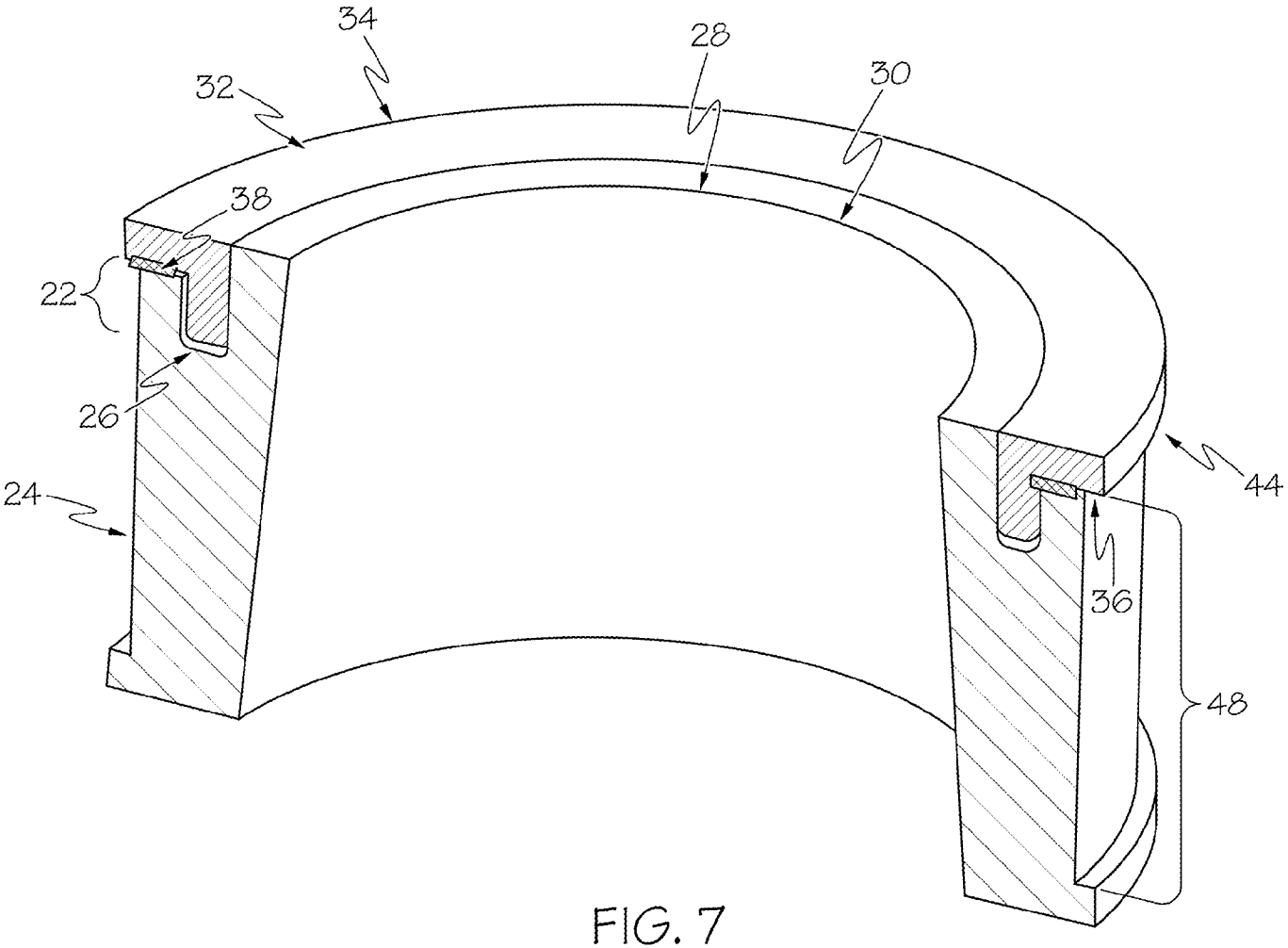
FIG. 7 illustrates the center gate mandrel and compensation ring providing tuned ring deflection pressure for controlling ID stack compression.

Referring to FIGS. 3-7, the devices and methods in accordance with the present invention provide accurate compression pressure on both the OD 8 and the ID 10 of the steel lamination stack 2 during high pressure metal casting in a two-plate tool. The devices and methods in accordance with the present invention include a hydraulically activated slider plate 12 having at least one tapered surface 14, and an annular die cast component 16 arranged perpendicular to an axis of motion of the slider plate 12. As shown in the figures, the axis of motion is preferably along the vertical axis of the slider plate 12, although it will be appreciated by those skilled in the art that other axes of movement are also contemplated, depending on the orientation of the stack height compensation assembly in general and the slider plate 12 in particular. A plurality of posts 18 are positioned and attached about the perimeter of the annular die cast component 16, with an end of each post 18 in contact with a tapered surface 14 of the slider plate 12. As shown in the figures, the plurality of posts 18 are preferably positioned and attached substantially equidistant and circumferentially about the perimeter of the annular die cast component 16. A mandrel 20 is positioned coaxial to the annular die cast component 16, with the mandrel 20 comprising a stepped distal periphery 22 such that a plurality of ferromagnetic laminations 4 may be stacked therebetween, the lamination stack 2 defining a lamination stack height, OD 8 and an ID 10. A compensation ring 32 is disposed along the distal periphery 22. The compensation ring 32 is configured to interposition with the stepped distal periphery 22 of the mandrel 20 such that a clearance gap 38 exists between the mandrel 20 and the compensation ring 32. The clearance gap 38 is designed to be greater than the allowable lamination stack variation (resulting from extra laminations 4 or burrs' 6 related expansion). Through the use of the slightly tapered 42 wedge sliding mechanism, the slider plate 12 engages and guides the posts 18 up the tapered surface 14, transferring pressure to the multiple guided posts 18 in the two-plate die cast tool. The posts 18 push directly on the annular shaped die component 16, transferring a compressive force through the annular die cast component 8 that exerts uniform clamping pressure on the OD 8 of the lamination stack 2. The slight taper 42 provides accurate OD 8 clamp pressure. Simultaneously, the mandrel 20 and the compensation ring 32 assist in providing accurate clamping pressure to the ID 10 of the lamination stack 2. The two-plate die exerts the compressive force on the compensation ring 32 that is designed to deflect (deform) 44 and provide a uniform specific pressure on the ID 10 of the lamination stack 2, as illustrated in FIG. 7. The compressive force deforms 44 the compensation ring 32 to close the clearance gap 38 a compensating degree such that the compensation ring 32 applies a uniform specific clamping pressure to the ID 10 of the lamination stack 2. As the two-plate die closes, the compensation ring 32 deflects at a precise pressure based on the thickness, geometry, and the tool steel (material) modulus. The mandrel 20 is of known length and the center portion of the mandrel 20 surface acts as a stop 30 and ring defection 44 is limited providing the desired ID stack clamping pressure. Thus, the clearance gap 38 determines how much variability can occur in the lamination stack 2, caused by burrs, flipped laminations, or additionally laminations. Concurrently, the compensation ring 32 controls and provides fine adjustment of the clamping pressure exerted through the annular die cast component 8 that exerts uniform clamping pressure on the OD 8 of the lamination stack 2.

In other embodiments, the slider plate 12 is comprised of a plurality of grooves 46, with each grove 46 having a tapered surface 14 such that upon hydraulic activation 40 of the slider plate 12 a groove 46 engages and guides a post 18 up a tapered surface 14. In further embodiments, the slider plate 12 comprises a brass wear surface. In additional embodiments, the slider plate 12 is hydraulically activated 40.

In certain embodiments, the stepped distal periphery 22 of the mandrel 20 comprises an outer planar surface 24, a recessed surface 26, and inner planer surface 28, with the inner planar surface 28 being a compression stop surface 30.

In other embodiments, the compensation ring 32 comprises an outer surface 34 that is substantially co-planar with the inner planar surface 28 of the mandrel 20 and which extends beyond the outer planar surface 24 of the mandrel 20 forming an overhang 36 and wherein the clearance gap 38 exists between the outer planar surface 24 and the compensation ring 32. In certain embodiments, upon activation the slider plate 12 engages and guides the posts 18 up the tapered surface 14 transferring a compressive force through the annular die cast component 16 and applying a clamping pressure to the OD 8 of the lamination stack 2, said compressive force deforming the compensation ring 32 to close the clearance gap 38 a compensating degree such that the compensation ring overhang 36 applies a clamping pressure to the inner diameter 10 of the lamination stack 2. With continued die closure the other half of the die bottoms out on mandrel 20 stop surface 30.

According to additional embodiments, the compensation ring 32 is fabricated from a deformable material having an elasticity modulus such that the clamping pressure applied to the ID 10 of the lamination stack 2 is tunable by selection of deformable material according to a desired elasticity modulus.

In certain embodiments, the compensation ring 32 possesses a ring geometry, see FIG. 7, such that the clamping pressure applied to the ID 10 of the lamination stack 2 is tunable by adjusting the ring geometry. In a more specific embodiment, the adjustable ring geometry comprises length and thickness. Other embodiments comprise adjusting a lateral side length of either or both of the mandrel 20 and compensation ring 32, while further embodiments comprise adjusting a lateral side thickness of either or both of the mandrel 20 and compensation ring 32.

In other embodiments, the clearance gap 38 is maximum and the compensating degree is zero at a resting state, and the maximum clearance gap 38 is set to be greater than a permissible lamination stack height variation. In a more specific embodiment, permissible lamination stack height variance is defined as plus or minus five lamination 4 plus a single lamination burr 6 height.

According to additional embodiments, the annular die cast component 16 comprises a casting cavity 48 and the mandrel 20 is configured to position the lamination stack 2 within the casting cavity 48. Thus, the mandrel 20 is also used to properly position the steel lamination stack 2 within the casting cavity 48 so no additional complexity is needed. The casting method utilizes a center shot position and therefore the projected area of the die cast cavity is minimized resulting in the ability to use smaller casting machine for manufacturing than would be required for a conventional method. The small projected areas allow for use of extremely high cavity pressure to further enhance the rotor casting quality. An additional advantage of this method is that the assembled steel lamination stack 2 and mandrel 20 can be preheated prior to casting enhancing thermal control and repeatability.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed:

1. A rotor die casting device comprising an integrated lamination stack height compensation assembly, the assembly comprising:

a moveable slider plate having at least one tapered surface;

an annular die cast component arranged perpendicular to an axis of motion of the slider plate;

a plurality of posts positioned about the perimeter of the annular die cast component, an end of each post in contact with the tapered surface of the slider plate;

a mandrel positioned coaxial to the annular die cast component and comprising a stepped distal periphery such that a plurality of ferromagnetic laminations may be stacked therebetween, the stack defining a lamination stack height, an outer diameter and an inner diameter; and a compensation ring disposed along the stepped distal periphery, the compensation ring configured to interposition with the stepped distal periphery of the mandrel such that a clearance gap exists between the mandrel and the compensation ring, the assembly configured such that upon activation, the slider plate engages and guides the posts up the tapered surface to transfer a compressive force through the annular die cast component such that a clamping pressure is applied to the outer diameter of the lamination stack, the compressive force sufficient to deform the compensation ring to close the clearance gap to a compensating degree sufficient to ensure that the compensation ring applies a clamping pressure to the inner diameter of the lamination stack.

2. The device according to claim 1, wherein the movable slider plate comprises a plurality of grooves, each groove comprising a tapered surface such that upon activation of the slider plate a groove engages and guides a post up a tapered surface.

3. The device according to claim 1, wherein the slider plate comprises a brass wear surface.

4. The device according to claim 1, wherein the moveable slider plate is hydraulically activated.

5. The device according to claim 1, wherein the stepped distal periphery comprises an outer planar surface, a recessed surface, and an inner planar surface, said inner planar surface being a compression stop surface.

6. The device according to claim 5, wherein the compensation ring comprises an outer surface substantially co-planar with the inner planar surface of the mandrel, the outer surface extending beyond the outer planar surface of the mandrel forming an overhang and wherein the clearance gap exists between the outer planar surface and the compensation ring.

7. The device according to claim 6, wherein upon activation, the slider plate engages and guides the posts up the tapered surface transferring a compressive force through the annular die cast component and applying a clamping pressure to the outer diameter of the lamination stack, said compressive force deforming the compensation ring to close the clearance gap a compensating degree such that the compensation ring overhang applies a clamping pressure to the inner diameter of the lamination stack.

8. The device according to claim 1, wherein the compensation ring is fabricated from a deformable material having an elasticity modulus such that the clamping pressure applied to the inner diameter of the lamination stack is tunable by selection of deformable material according to a desired elasticity modulus.

9. The device according to claim 1, wherein the compensation ring possesses a ring geometry such that the clamping pressure applied to the inner diameter of the lamination stack is tunable by adjusting the ring geometry.

10. The device according to claim 9, wherein the adjustable ring geometry comprises length and thickness.

11. The device according to claim 1, wherein the clearance gap is maximum and the compensating degree is zero at a resting state, and the maximum clearance gap is set to be greater than a permissible lamination stack height variation.

12. The device according to claim 11, wherein permissible lamination stack height variance is defined as plus or minus five laminations plus a single lamination burr height.

13. The device according to claim 1, wherein the annular die cast component comprises a casting cavity and the mandrel is configured to position the lamination stack within the casting cavity.

14. A method of compensating for lamination stack height variation in the manufacture of a die cast rotor, the method comprising:

providing a compensation assembly integrated with a die casting tool, said compensation assembly comprising a moveable activated slider plate having at least one tapered surface; an annular die cast component arranged perpendicular to an axis of the slider plate; a plurality of posts positioned about the perimeter of the annular die cast component, an end of each post in contact with the tapered surface of the slider plate; a mandrel positioned coaxial to the annular die cast component and comprising a stepped distal periphery such that a plurality of ferromagnetic laminations may be stacked there between, the stack defining a lamination stack height, an outer diameter and an inner diameter; a compensation ring disposed along the distal periphery, the compensation ring configured to interposition with the stepped distal periphery of the mandrel such that a clearance gap exists between the mandrel and the compensation ring, the assembly configured such that upon activation, the moveable slider plate engages and guides the posts up the tapered surface to transfer a compressive force through the annular die cast component such that a uniform clamping pressure is applied to the outer diameter of the lamination stack, the compressive force sufficient to deform the compensation ring to close the clearance gap to a compensating degree to ensure that the compensation ring applies a uniform clamping pressure to the inner diameter of the lamination stack.

15. The method according to claim 14, wherein the slider plate comprises a plurality of grooves, each groove comprising a tapered surface such that the step of activating the moveable slider plate engages and guides each post up a tapered surface of a groove.

16. The method according to claim 14, wherein the slider plate comprises a brass wear surface.

17. The method according to claim 14, wherein the moveable slider plate is hydraulically activated.

18. The method according to claim 14, wherein the stepped distal periphery comprises an outer planar surface, a recessed surface, and an inner planar surface, said inner planar surface being a compression stop surface.

19. The method according to claim 18, wherein the compensation ring comprises an outer surface substantially coplanar with the inner planar surface of the mandrel, the outer surface extending beyond the outer planar surface of the mandrel forming an overhang and wherein the clearance gap exists between the outer planar surface and the compensation ring.

20. The method according to claim 19, wherein upon activation, the slider plate engages and guides the posts up the tapered surface transferring a compressive force through the annular die cast component and applying a clamping pressure to the outer diameter of the lamination stack, said compressive force deforming the compensation ring to close the clearance gap a compensating degree such that the compensation ring overhang applies a clamping pressure to the inner diameter of the lamination stack.

21. The method according to claim 14, wherein the compensation ring is fabricated from a deformable material having an elasticity modulus, further comprising tuning the clamping pressure applied to the inner diameter of the lamination stack by selecting deformable material according to a desired elasticity modulus.

22. The method according to claim 14, wherein the compensation ring possesses a ring geometry, further comprising tuning the clamping pressure applied to the inner diameter of the lamination stack by adjusting the ring geometry.

23. The method according to claim 14, wherein the annular die cast component comprises a casting cavity and the mandrel is configured to position the lamination stack within the casting cavity, the method further comprising die casting according to a center shot position.

* * * * *